US005415910A

United States Patent [19]

Knauf

[11] Patent Number: 5,415,910

[45] Date of Patent: May 16, 1995

[54] CONTAINER LINER FOR DOUGH PRODUCTS

[75] Inventor: Gary H. Knauf, Appleton, Wis.

[73] Assignee: International Paper Company, Purchase, N.Y.

[21] Appl. No.: 255,090

[22] Filed: Jun. 7, 1994

Related U.S. Application Data

[63] Continuation-in-part of Ser. No. 963,891, Oct. 19, 1992, abandoned.

[51] Int. Cl.[6] ..... B65D 85/36; B65D 5/54

[52] U.S. Cl. ..... 428/34.3; 428/35.9; 428/181; 428/200; 428/349; 428/461; 428/464; 428/514; 428/520; 426/126; 426/128; 206/803; 229/3.1; 229/4.5; 229/202

[58] Field of Search ..... 426/126, 128; 428/34.2, 428/36.6, 35.9, 461, 464, 514, 34.3, 36.7, 349, 200, 181, 520; 206/830, 627, 631; 229/4.5, 3.1, 201, 202

[56] References Cited

U.S. PATENT DOCUMENTS

| | | | |
|---|---|---|---|
| 3,185,577 | 5/1965 | Krause | 99/171 |
| 3,506,183 | 4/1970 | Turpin et al. | 229/51 |
| 3,712,534 | 1/1973 | Fienup et al. | 229/51 |
| 3,940,496 | 2/1976 | Turpin et al. | 426/123 |
| 3,972,468 | 8/1976 | Reid | 229/51 |
| 3,981,433 | 9/1976 | Thornhill et al. | 229/51 |
| 3,982,686 | 9/1976 | Parlour et al. | 229/51 |
| 4,073,950 | 2/1978 | Hansen et al. | 426/128 |
| 4,093,073 | 6/1978 | Leezer | 206/606 |
| 4,235,341 | 11/1980 | Martin et al. | 206/601 |
| 4,241,130 | 12/1980 | Barnes | 428/216 |
| 4,389,438 | 6/1983 | Ohbuki et al. | 428/35.8 |
| 4,418,841 | 12/1983 | Eckstein | 222/107 |
| 4,539,259 | 9/1985 | Zuscik | 428/332 |
| 4,760,949 | 8/1988 | Elias | 229/4.5 |

OTHER PUBLICATIONS

Tappi Proceedings, 1988 Polymers, Laminations and Coatings Conference, Atlanta, Ga. Sep. 13-16, 1988.

Nucrel O910NS Product Bulletin Dupont Company, Polymer Products Dept. Packaging Products Division, Wilmington, De. 19898.

*Primary Examiner*—Ellis P. Robinson
*Assistant Examiner*—Rena L. Dye
*Attorney, Agent, or Firm*—Luedeka, Neely & Graham

[57] ABSTRACT

An inner layer, i.e. liner, for a generally tubular, multi-layered dough container comprising a laminated web suitable for being helically wound into a tubular geometry and which includes a plurality of layers, the innermost of such web layers providing improved bonding characteristics for the liner, hence improved containment and sealing of the dough, and a container including such liner.

8 Claims, 1 Drawing Sheet

CONTAINER LINER FOR DOUGH PRODUCTS

This application is a Continuation-In-Part of application Ser. No. 07/963,891 filed Oct. 19, 1992, which is now abandoned.

This invention relates to containers for the storage of refrigerated dough products, such as biscuit dough, during the time period between formulation of the dough and its ultimate use by a consumer, and more particularly to an inner layer for such containers.

BACKGROUND OF THE INVENTION

Dough products, such as biscuit dough, are formulated and packaged in containers suitable for storage under refrigerated conditions. Because the dough exudes carbon dioxide during storage, accommodation must be made for pressure increases within the container during storage. Further, the dough also exudes greases and/or syrups that are degradative to paper, water-based glues, etc. Dough containers commonly are generally tubular, multilayered and comprise an inner layer, i.e. liner, that is in direct contact with the dough, a strength layer such as heavy paper, paperboard or cylinderboard and a label layer which is the outermost of the layers.

The prior art containers commonly are manufactured by serially helically winding the several layers about a cylindrical mandrel with the contiguous side edges of at least certain of the layers being bonded to one another to form an integral tube. This tube is finally cut into suitable lengths. U.S. Pat. Nos. 3,940,496 and 4,073,950, incorporated herein by reference, disclose methods for manufacturing such tubes. One end of each tube is sealed with a metal end cap as by swaging the periphery of the end cap to the tube to effect a seal therebetween. In one embodiment, the seal between the end cap and the tube wall is less than gas tight thereby leaving an escape route for gas exuding from the contained dough. This technique enables one to use a container of less burst strength (hence less costly). After the tubular container is filled with dough product, the opposite open end of the tube is closed and sealed in like manner using a further metal end cap. U.S. Pat. Nos. 3,506,183 and 4,235,341, incorporated herein by reference, disclose prior art helically wound dough containers. Commonly, in the lay-up of the layers of container, the contiguous side edges of the strength layers are abutting. This helical butt joint is held in place by a bond between the strength layer and the liner layer, plus a bond provided by an outer label layer which is peelable from the strength layer. By design, the label layer provides sufficient strength to the container to prevent the helical seal from rupturing until the label layer is peeled away whereupon the helical seal ruptures due to the pressure developed internally of the container. In some containers, opening of the containers by the consumer is most frequently accomplished by physically rupturing the helical seal as by striking the body of the container against a sharp corner of a kitchen cabinet or the like. Desirably, when using this procedure, the seal consistently ruptures at the point of impact of the container against the sharp edge.

Prior art liners for dough containers are known to include urea formaldehyde treated paper glue laminated to an aluminum foil as a gas and moisture barrier layer, which in turn is bonded to a very thin (e.g. about 1 lb/3MSF) polyvinyl chloride based heat seal coating, such coating serving to effect the bond between the contiguous edges of the helically wound web during layup of the liner in a helically wound configuration. Such prior art liners suffer from severe environmental problems. Specifically, the use of urea formaldehyde in papermaking results in free formaldehyde in the area of the papermaking machine, such formaldehyde being a potential health hazard to workers. Accordingly, it is required that protective measures be taken for such workers, such measures resulting in higher costs for production of the paper product. Further, urea formaldehyde-treated papers are difficult to use as a source product for the manufacture of recycled paper. Still further, the polyvinyl chloride of the prior art containers poses a prohibited chemical problem under certain state regulations, such as California Proposition 65, as being carcinogenic and/or a reproductive toxin. The incineration of containers containing polyvinyl chloride also generates HCl which is a purported source of acid rain. The present container liner is free of urea formaldehyde, polyvinyl chloride and similar potential environmental hazards.

SUMMARY OF THE INVENTION

The present invention is directed to the inner layer, i.e. the liner, of a generally tubular multilayered container for the dough. Such inner liners are exposed directly to the dough and its several ingredients. Especially, the liner is subjected directly to the degradative effects of syrups that are exuded from the dough over time and during the storage life of the product, and to the increasing gas pressure within the container. Present known containers formed from paper products are known to have shelf life of only about 45 days (under controlled conditions of 100% RH, temperature cycled between 40° F. and 60° F. every six hours) inasmuch as the liner layer of such containers tends, within such time period, to degrade to the extent that it fails to function, commonly rupturing catastrophically, and permits the dough to escape and/or become exposed to the environment exterior to the container. The present inventor has found that such degradation is due in large extent to the migration of syrups from the dough in the interior of the container to the ends of the tubular liner where they penetrate the ends of the liner and migrate along the helical seal of the wound tubular portion of the container and weaken the helical seal. Due to the desire to permit a small gas escape route around the ends of the tubular portion and past the end cap seal between the liner and the end cap, the ends of the container are particularly subject to such migration of the syrups, etc. Syrup migration is particularly a problem in that area or areas of the end seal where the helical seal falls with the end seal. In this manner, the syrups migrate past the foil barrier layer of the liner. The syrups thereafter appear to migrate preferentially along the region of the contiguous side edges of the helically wound tube and degrade the paper layers of the liner and/or the strength layer, and/or the helical seal itself, thereby destroying the ability of the container to contain the pressurized dough product. Consequently, the weakened container ruptures catastrophically.

Specifically, in accordance with the present invention there is provided an inner layer, i.e. liner, for a generally tubular multilayered dough container, such liner comprising a laminated web suitable for helically winding into a tubular geometry and which includes a plurality of layers, the first of which is a gluable paper layer, for example a paper layer having a basis weight of between about 17 to about 35 lb/3MSF which is free of wet strength additives, an extrudable adhesive layer(s), a vapor and moisture barrier layer, such as aluminum foil which is suitable to provide a vapor and moisture barrier through the thickness of the liner, and an innermost layer which includes two extrudable agents, e.g. a bonding agent and a heat sealing agent. The bonding agent is capable of effecting a suitable bond between the barrier layer and the heat sealing agent, which in turn, is suitable for forming a heat seal when the contiguous edges of the innermost layer, when helically wound, are folded back on one another to form a pleat-type helical seal for the liner. Preferably, the bonding agent and the heat sealing agent comprise a multilayered coextrusion, the bonding agent forming a preferred bond with aluminum foil and the heat sealing agent forming a preferred bond with itself in the folded-back seal, and the two such coextruded layers being mutually bondable one to another. A type of folded-back seal as referred to herein is described in U.S. Pat. Nos. 4,073,950 and 3,156,401, both of which are incorporated herein by reference.

BRIEF DESCRIPTION OF THE DRAWINGS

It is therefore an object of the present invention to provide an improved inner liner for a container for dough and similar products. It is another object to provide a container for dough products or the like which is free of potentially environmentally undesirable materials and whose manufacturing process is likewise free of such materials. It is another object to provide a container for dough products that offers increased shelf life for the contained product. These and other objects and advantages of the invention will be recognized from the description contained herein, including the drawings in which.

DESCRIPTION OF THE PREFERRED EMBODIMENTS

Figure 1:
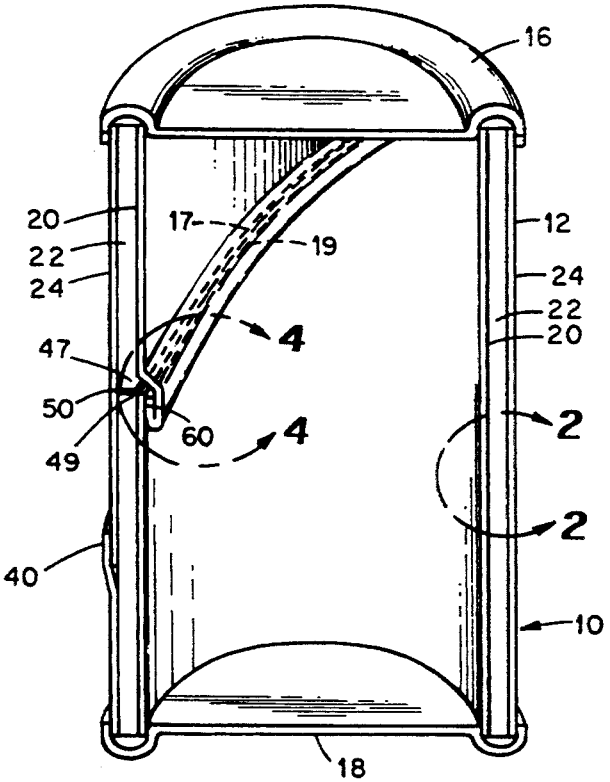
FIG. 1 is a schematic representation, in section, of one embodiment of a dough container including a multilayered liner product of the present invention.

With reference to FIG. 1, there is depicted in section, a container 10 for dough products and including a multilayered tubular section 12 formed from helically wound layers 20, 22, 24, and closed at its opposite ends as by end caps 16 and 18. Abutting (or overlapping, depending upon the method of manufacture) contiguous edges of the webs 20, 22 and/or 24 are bonded together to form a helical seal 60 and complete a container which is capable of withstanding up to about 40 psi pressure exerted by dough contained therein.

Figure 2:
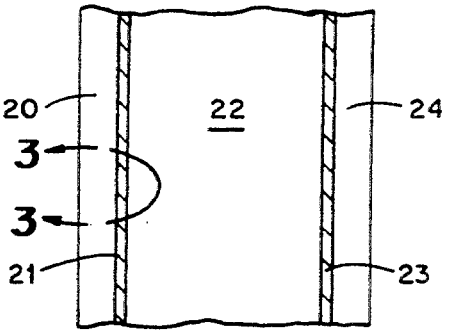
FIG. 2 is an enlarged and exaggerated fragmentary sectional view taken along line 2—2 through the thickness dimension of the wall of the container of FIG. 1.

Referring to FIG. 2, the tubular section of the depicted container 10 is multilayered, comprising an inner layer (liner) 20, a strength layer 22 and an outer (or label) layer 24. Adhesive layers 21 and 23 are applied to adhere the three layers together. The strength layer 22 may be of conventional design and construction which commonly comprises paperboard of about 245 lb/3MSF basis weight which is preferably free of environmentally unacceptable wet strength additives. The outer label 24 may be of a variety of construction including paper or a laminate or paper and aluminum foil. The outer label is normally printed. In the depicted container, the contiguous side edges 47 and 49 of the helically-wound cylinderboard layer 22 abut to define a helical butt joint 50 that underlies and parallels the helical seal 60 of the inner liner 20.

Figure 3:
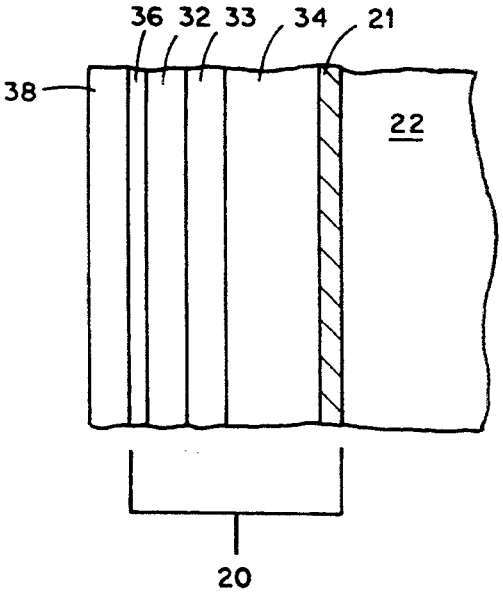
FIG. 3 is an exaggerated enlarged sectional view taken along the line 3—3 of FIG. 2.
Figure 4:
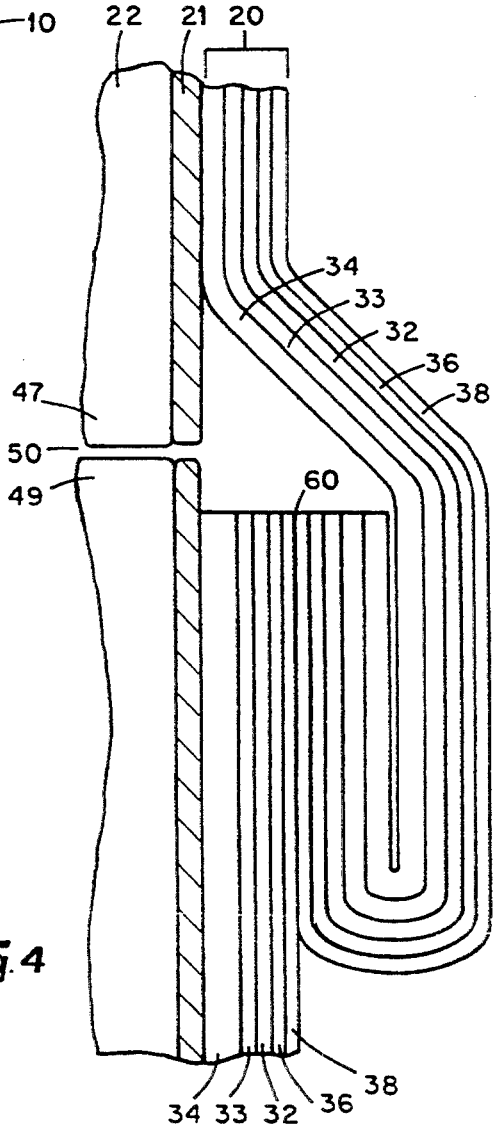
FIG. 4 is an enlarged representation, in section, of a fragmentary portion of a helical seal of the type in which contiguous side edges of a helically wound layer are folded back upon themselves in a pleat-type seal.

In FIG. 3, there is depicted a sectional view, enlarged and exaggerated for purposes of illustration, of a portion of the wall of the container 10 and depicting a portion of the strength layer 22 and a portion of an inner layer (liner) 20 in accordance with the present invention. Specifically, the liner 20 comprises a glueable paper layer 34, an adhesive layer 33, a gas and moisture barrier layer 32, an adhesive layer 36, and a heat seal layer 38 that is intended to be in direct contact with the dough in the container. This barrier layer 32, in accordance with the present invention, preferably comprises a layer of aluminum foil. In the instance where the layer 32 is aluminum foil, it is of a thickness of at least between about 0.0002 and about 0.0003 inch, and most preferably about 0.000250 inch to about 0.000285 inch, and has applied and bonded thereto a multilayer coextrusion comprising a polyethylene methylacrylic acid copolymer resin layer 36, such as NUCREL (DuPont) or a polyethylene acrylic acid such as PRIMACOR (Dow) which bonds well to aluminum foil, and a layer 38 of heat sealing material, e.g. high density polyethylene (HDPE). The NUCREL or PRIMACOR is provided as a substantially uniform layer of between about 1 and about 2 lb/3MSF and most preferably about 1.5 lb/3MSF. The HDPE layer 38 is of a substantially uniform thickness which is capable of forming a pleat-type seal when the layer 20 is folded back upon itself with HDPE surfaces of contiguous side edges facing one another along the length of the helical seal. This HDPE layer is important with respect to obtaining an acceptable heat seal along the helical seal of the inner liner of the present invention. Specifically, through the choice of HDPE and selection of the quantity of HDPE which is present in the layer (which also determines the thickness of the HDPE layer), the present inventor provides that amount of heat sealable material which will effect a full and complete helical seal along the contiguous side edges of the helically wound inner layer. To this end, between about 6.0 and about 7.0 lb/3MSF of HDPE is coextruded with and onto the layer of acrylic acid copolymer resin, and most preferably about 6.5 lb/3MSF of HDPE. It will be recognized that when such a layer of HDPE is folded back upon itself into a pleat-type seal (see FIG. 4), in the seal area there is provided twice such quantity of HDPE. This quantity of HDPE has been found to be important in that first it provides that quantity of heat sealable material which can readily be processed through existing container-manufacturing equipment and, second, the HDPE exhibits a uniform melting temperature which permits the formation of a well integrated seal of substantially uniform strength upon cooling of the heated seal area. This is in contrast to the prior art where the polyvinyl chloride heat sealing materials employed exhibit non-uniform or spotty melting characteristics, hence produce seals which exhibit relative weak and strong areas along their length and which tend to burst at unexpected and undesirable locations along such seal length. The use of a coextrusion as described hereinabove provides the advantage of an excellent bond between the aluminum foil and the HDPE, the acrylic acid copolymer NUCREL or PRIMACOR effecting a better bond to aluminum than does HDPE, so that the present inventor not only provides for a strong uniform seal, but at the same time he provides for excellent strong bonding of the sealing material to the aluminum foil, thereby contributed to the overall integrity of the inner liner and its ability to effectively contain the dough and its byproducts. A ratio of 20% to 80%, by weight, ±5%, 9% acid of NUCREL or PRIMACOR to HDPE is preferred as providing effective sealing and bonding of the HDPE to the aluminum foil, and further a seal which can be broken readily and predictably at the time of use by the consumer. Lesser quantities of HDPE do not provide uniform and adequate seals, whereas greater quantities of HDPE develop seals that are difficult to rupture by the consumer.

On that surface of the gas and moisture barrier layer 32 opposite the surface thereof which has adhered thereto the coextrusion layers 36 and 38, there may be provided any of several gluable papers. In a preferred embodiment, where aluminum foil is employed as the barrier layer, such opposite surface of the barrier layer 32 is provided with an overlying layer 34 of paper, e.g. between about 17 and about 35 lb/3MSF unbleached machine glazed kraft paper, and most preferably about 20 to 25 lb/3MSF, which is bonded to the aluminum foil as by an adhesive layer 33 of NUCREL or PRIMACOR acrylic acid copolymer of between about 6.5 and about 7.5 lb/3MSF, and most preferably about 7.0 lb/3MSF. Heavier or lighter paper layers, may be employed so long as the paper is capable of being processed through mechanical equipment for the manufacture of the container, especially through extrusion coating and laminating equipment and is free of potential environmentally undesirable materials. Adhesives other than NUCREL or PRIMACOR may be employed to bond the paper layer to the aluminum foil, e.g. low density polyethylene (LDPE) or acrylic acid copolymers other than the NUCREL or PRIMACOR type. LDPE and acrylic acid copolymers bond about equally well to paper, but LDPE bonds less tenaciously to the aluminum, so that if desired, a coextrusion of LDPE and NUCREL or PRIMACOR may be employed for such bond, depending upon the equipment available and the economics involved with a particular manufacturing operation. If desired, appropriate adhesives may include water-based adhesives. The adhesives also may be applied by spray coating techniques, roll coaters, etc.

The gas and moisture barrier layer 32 of the present invention desirably has oxygen and carbon dioxide transmission rates of less than 0.1 cc/100 inch$^2$/day/atm @75° F. with dry or wet pure gases. Suitable barrier materials other than aluminum foil include aluminum metallized polyester (PET) films, aluminum metallized oriented polypropylene (OPP) films, aluminum metallized paper webs, and silicon dioxide coated films. The thickness of a particular film or combination is chosen to provide the above-stated oxygen and carbon dioxide transmission rates.

It will be recognized that the disclosed inner layer of the present invention contains no component that includes urea formaldehyde or polyvinyl chloride. Thus containers having inner liners of the present invention may be disposed of by incineration without the production of HCl vapors. Paper companies may produce the liner material without testing paper machine air space for free formaldehyde contamination. The present containers can be sold without warning labels relating to potential environmental hazards.

Importantly, dough-filled containers of the present invention provide an increased shelf life for the product. As noted hereinabove, the prior art containers for dough products have an average shelf life of about 45 days tested under controlled conditions of 100% RH, temperature cycled between 40° F. and 60° F. every six hours. Containers made in accordance with the present invention have an average shelf life of about 65 days tested under identical conditions. Examination of containers which were tested to failure revealed that containers made in accordance with the present invention exhibited substantially no migration of syrups through the helical seal. The only migration of syrups occurred around the ends of the tubular portion of the container in the area of the end cap seal. Prior art containers failed at a higher rate because syrup migration occurred both through the helical seal and around the end caps. Since the syrup migration rate was higher, the failure rate was higher. Failure occurs when enough syrup migrates into the label layer 24 and lowers its tensile strength enough to allow the internal can pressure to tear open the label.

Whereas the present invention has been described in terms of helically wound liners having helical seals, it is to be recognized that other seal geometries or configurations may be employed with like improvements. For example, the seal may be formed Parallel to the length of the container.

I claim:

1. A multilayered inner liner for a helically wound tubular container having a multilayered cylindrical wall and closed opposite ends for confining dough products which exude a syrup-like liquid over time during containment comprising a helically wound laminate assembly including a heavy weight paperboard strength layer that is substantially free of urea formaldehyde wet strength additive and polyvinyl chloride adhesive for bonding said inner liner which comprises an unbleached, machine glazed, 17 to 35 lb./3MSF basis weight kraft paper web first layer that is also free of wet strength additives, a chloride-free adhesive second layer, a gas and moisture barrier third layer and a fourth layer comprising a coextruded lamination of acrylic acid copolymer resin and high density polyethylene resin, said layers being disposed in the foregoing listed sequence with the high density polyethylene resin laminae of said fourth layer being innermost of said container and adapted to be in physical contact with said syrup-like exudate from said dough product, said layers being helically wound into a generally tubular geometry with contiguous side edges of said first through fourth layer being formed into a pleat-type helical seal in which one of said contiguous side edges of said liner is folded back upon itself whereby said fourth layer in the region of this fold and which bears said high density polyethylene resin is in facing relationship and substantially uniformly heat sealed to itself along the length of such pleat-type seal to thereby form an effective seal against the leakage of said syrup-like exudate into said helical seal along the length of said seal and to reduce the migration of said syrup-like exudate out of said container in the area of its closed ends.

2. The multilayered inner liner of claim 1 wherein said fourth layer acrylic acid copolymer resin is selected from the group consisting of polyethylene acrylic acid resin and polyethylene methylacrylic acid resin.

3. The multilayer inner liner of claim 1 wherein said second layer is an acrylic acid copolymer resin selected from the group consisting of polyethylene acrylic acid resin and polyethylene methyacrylic acid resin.

4. The multilayer inner liner of claim 2 wherein said third layer comprises a 0.0002 inch to 0.0003 inch thickness of aluminum foil.

5. The multilayer inner liner of claim 3 wherein said third layer comprises a 0.0002 inch to 0.0003 inch thickness of aluminum foil.

6. The multilayer inner liner of claim 4 wherein said coextruded fourth layer comprises about 20% acrylic acid copolymer resin and about 80% high density polyethylene resin.

7. The multilayer inner liner of claim 6 wherein said high density polyethylene resin portion of said fourth layer is coextruded at the rate of about 6 lb/3MSF to about 7 lb/3MSF.

8. The multilayer inner liner of claim 4 wherein said first layer comprises an unbleached, machine glazed, kraft paper having a basis weight of between about 17 lb./3MSF to about 35 lb./3MSF.

* * * * *

UNITED STATES PATENT AND TRADEMARK OFFICE

CERTIFICATE OF CORRECTION

PATENT NO. : 5,415,910

DATED : May 16, 1995

INVENTOR(S) : Gary H. Knauf

It is certified that error appears in the above-indentified patent and that said Letters Patent is hereby corrected as shown below:

On the title page:

[63] under the title "Related U.S. Application Data", after "abandoned", insert --, which is a continuation of Ser. No. 579,055, September 7, 1990, abandoned. --

In Column 1, at line 6, after "abandoned" insert --, and which is a continuation of Ser. No. 07/579,055, filed September 7, 1990, now abandoned --

Signed and Sealed this

Eleventh Day of February, 1997

Bruce Lehman

BRUCE LEHMAN

*Commissioner of Patents and Trademarks*

*Attest:*

*Attesting Officer*